US010186802B1

(12) United States Patent
Chen et al.

(10) Patent No.: US 10,186,802 B1
(45) Date of Patent: Jan. 22, 2019

(54) CONNECTING DEVICE WITH HIGH-DENSITY CONTACTS

(71) Applicant: NEXTRONICS ENGINEERING CORP., New Taipei (TW)

(72) Inventors: Yen-Cheng Chen, New Taipei (TW); Chi-Jung Chan, New Taipei (TW)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 15/949,270

(22) Filed: Apr. 10, 2018

(30) Foreign Application Priority Data

Dec. 29, 2017 (TW) ..... 106146528 A

(51) Int. Cl.

| | |
|---|---|
| ***H01R 13/625*** | (2006.01) |
| ***H01R 12/70*** | (2011.01) |
| ***H01R 13/629*** | (2006.01) |
| ***H01R 13/20*** | (2006.01) |
| ***H01R 13/627*** | (2006.01) |
| ***H01R 12/71*** | (2011.01) |
| ***H01R 13/11*** | (2006.01) |
| *H01R 13/04* | (2006.01) |

(52) U.S. Cl.
CPC ..... *H01R 13/625* (2013.01); *H01R 12/707* (2013.01); *H01R 12/718* (2013.01); *H01R 13/112* (2013.01); *H01R 13/20* (2013.01); *H01R 13/629* (2013.01); *H01R 13/6278* (2013.01); *H01R 13/04* (2013.01)

(58) Field of Classification Search
CPC .. H01R 12/707; H01R 12/718; H01R 13/112; H01R 13/20; H01R 13/04
See application file for complete search history.

(56) References Cited

U.S. PATENT DOCUMENTS 7,674,113 B2 * 3/2010 Di Stefano ..... H01R 4/027 439/66
2012/0238126 A1 * 9/2012 Damodharan ..... H01R 4/2433 439/395

(Continued)

FOREIGN PATENT DOCUMENTS

TW M461917 U1 9/2013

*Primary Examiner* — Briggitte R Hammond
(74) *Attorney, Agent, or Firm* — Li & Cai Intellectual Property (USA) Office

(57) ABSTRACT

A connecting device with high-density contacts includes a plug connector and a socket connector. The plug connector has a first insulated housing and a plurality of first terminals. The first insulated housing has a post portion. The first terminals are disposed on the post portion. The socket connector has a second insulated housing and a plurality of second terminals. The second insulated housing has a barrel portion formed with an accommodating space. The second terminals are disposed on the barrel portion. The post portion of the plug connector is inserted into the accommodating space. The plug connector and the socket connector are rotatable relative to each other. First contacting portions of the first terminals are clipped between two contacting portions of the second terminal, so that the first terminals are conductively contacted with the second terminals. Thus, the present disclosure provides signal contacts with high-density and high-reliability.

13 Claims, 9 Drawing Sheets

(56) References Cited

U.S. PATENT DOCUMENTS

| | | | | |
|---|---|---|---|---|
| 2014/0213118 | A1* | 7/2014 | Glynn | A61N 1/3752<br>439/675 |
| 2014/0235085 | A1* | 8/2014 | Su | H01R 13/6277<br>439/346 |
| 2015/0162697 | A1* | 6/2015 | Jones | H01R 13/516<br>439/607.01 |

* cited by examiner

CONNECTING DEVICE WITH HIGH-DENSITY CONTACTS

BACKGROUND OF THE INVENTION

1. Field of the Invention

The present disclosure is related to a connecting device, in particular, to a connecting device with high-density contacts.

2. Description of Related Art

The existing connectors are used as connection devices for electrically connecting to a cable, a circuit board, and other circuit elements, and have been widely applied to various electronic products in our daily life. Although connectors have been applied to the field of medical instruments, some necessary for medical instruments developed with new technology for enhancing functions need more contacts and to be integrated with new functions. Accordingly, the connectors need more contacting points for transmitting. But, the number of contacts of the conventional single connector is limited, and a plurality of connectors are necessarily provided to achieve the electrical connecting effect. However, increasing the number of connectors will occupy a larger space, resulting in the inconvenience of the operation of medical instruments.

Hence, the inventor of the present disclosure believes that the above-mentioned disadvantages can be overcome, and has been studying and working on the case. Finally, the present disclosure which has a better design is proposed to effectively improve the above-mentioned disadvantages.

SUMMARY OF THE INVENTION

One of the objectives of the present disclosure is to provide a connecting device with high-density contacts, which is able to effectively increase the density of contacts and ensure the contacting force, so as to provide signal contacts with high-density and high-reliability.

In order to achieve the above objectives, according to one exemplary embodiment of the present disclosure, a connecting device with high-density contacts is provided and includes a plug connector and a socket connector. The plug connector has a first insulated housing and a plurality of first terminals. The first insulated housing has a post portion, and the first terminals are disposed on the post portion. The first terminals respectively have a first contacting portion and a first soldering portion which is connected to the first contacting portion. The first contacting portions of the first terminals are exposed outside an outer surface of the post portion. The socket connector has a second insulated housing and a plurality of second terminals. The second insulated housing has a barrel portion, and the barrel portion has an accommodating space formed therein. The second terminals are disposed on the barrel portion of the second insulated housing. The second terminals respectively have two second contacting portions and a second soldering portion connected to the two second contacting portions. The post portion of the plug connector is capable of inserting into the accommodating space of the socket connector. The plug connector and the socket connector are rotatable relative to each other, so that the first contacting portions of the first terminals are respectively clipped between the two second contacting portions of the second terminals. Therefore, the first terminals are conductively contacted with the second terminals, respectively.

In a preferred embodiment, the post portion of the plug connector is a cylinder, and the accommodating space of the socket connector is circular-shaped.

In a preferred embodiment, the first contacting portions of the first terminals are arranged in a plurality of rows along an axial direction of the post portion, and the two second contacting portions of the second terminals are arranged in a plurality of rows along an axial direction of the barrel portion.

In a preferred embodiment, the two second contacting portions of the second terminals are strip-shaped and are arranged oppositely to each other; wherein the two second contacting portions of the second terminals respectively have a front part, a rear part and an intermediate part, the intermediate part is connected between the front part and the rear part, an included angle is formed between the intermediate part and the front part, and an included angle is formed between the intermediate part and the rear part, such that the second contacting portion is formed to have multi-segment bends.

Thus, the present disclosure has the advantages as follows.

The connecting device with high-density contacts of the present disclosure includes a plug connector and a socket connector. The plug connector and the socket connector respectively utilize the post portion with the first terminals and the barrel portion with the second terminal, and use the outer surfaces (such as the circumference surface) of the post portion and the barrel portion to the maximum extent to produce high-density and high-reliable signal contacts within a limited volume. In addition, the first contacting portions of the first terminals are clipped between the second contacting portions of the second terminals. Therefore, effective contacting forces can be provided effectively, and the first terminals and the second terminals are stably contacted and conducted.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

Figure 1:
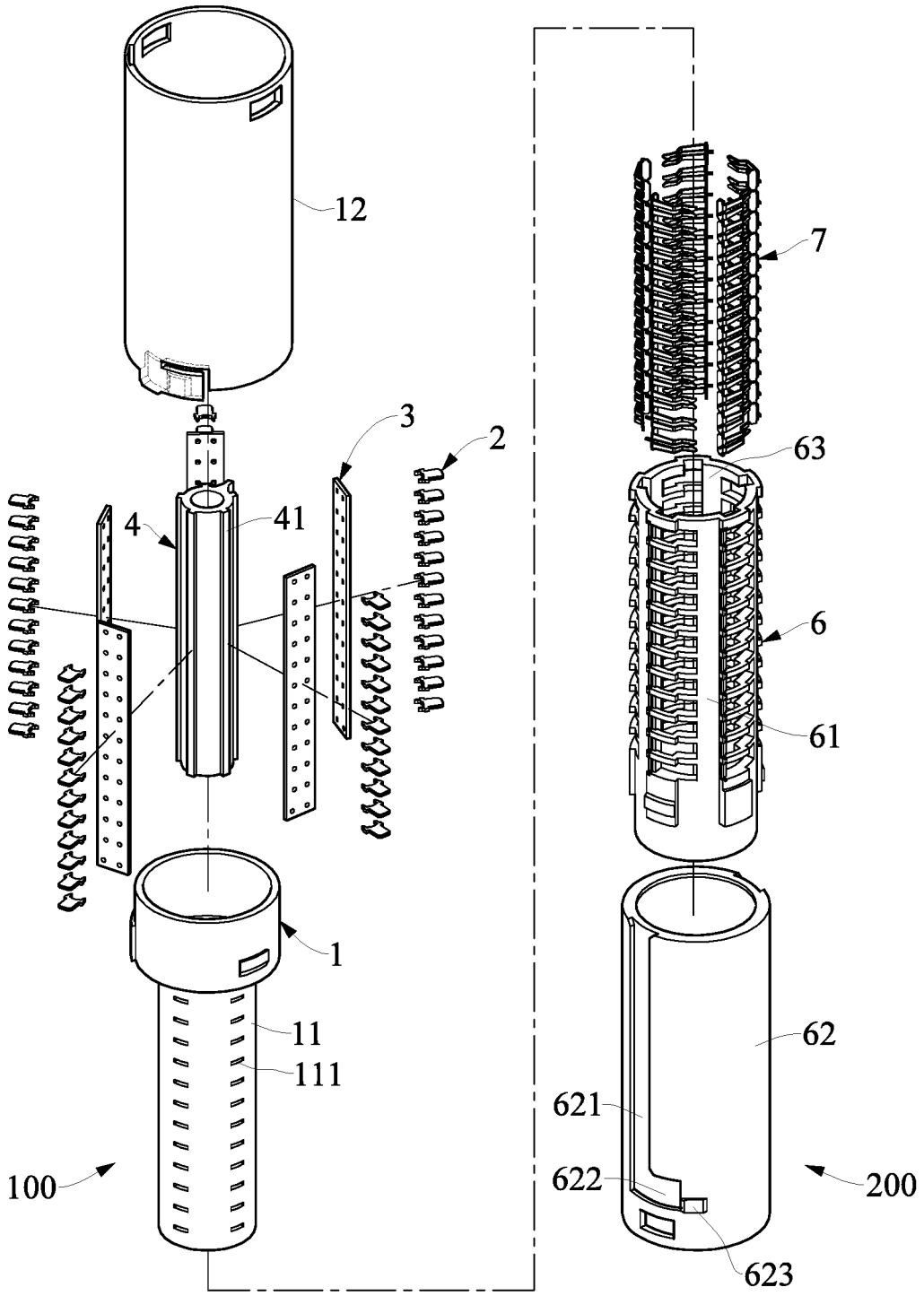
FIG. 1 is a three-dimensional exploded view of a connecting device with high-density contacts of the present disclosure.
Figure 2:
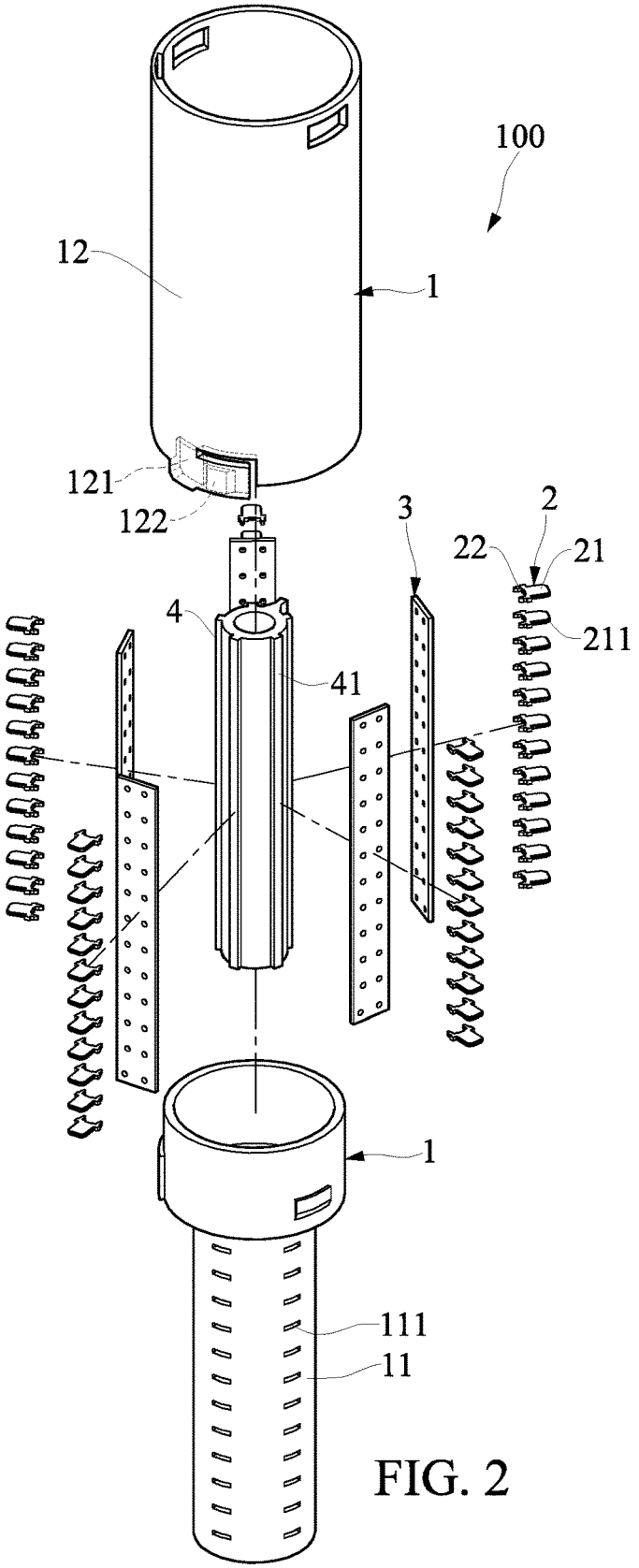
FIG. 2 is a three-dimensional exploded view of a plug connector of the present disclosure.
Figure 3:
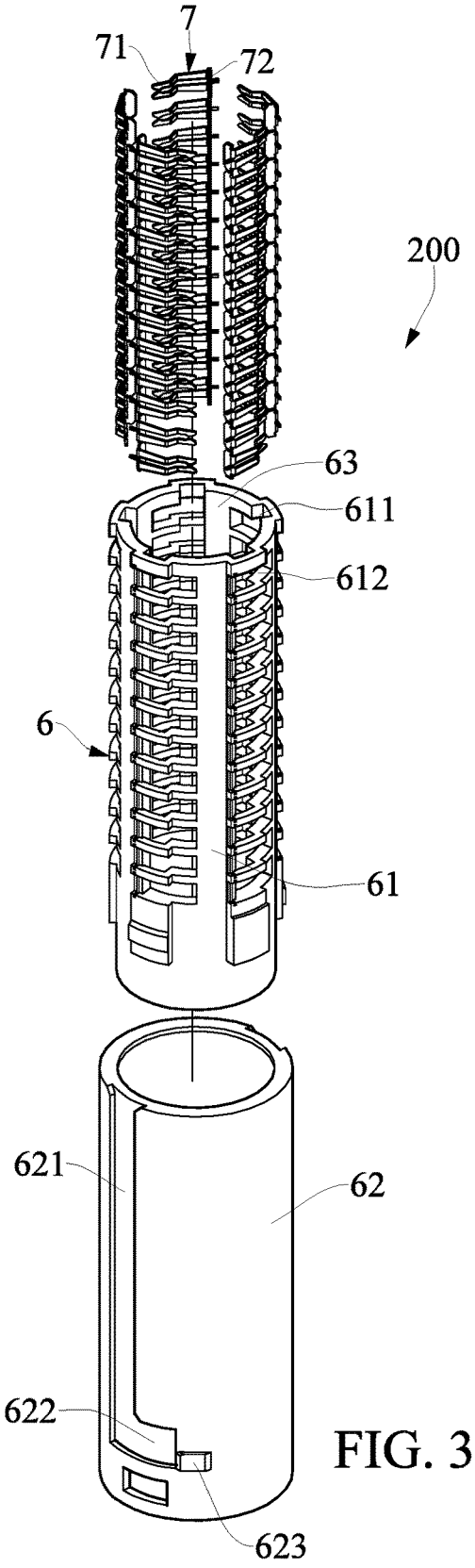
FIG. 3 is a three-dimensional exploded view of a plug connector of the present disclosure.
Figure 4:
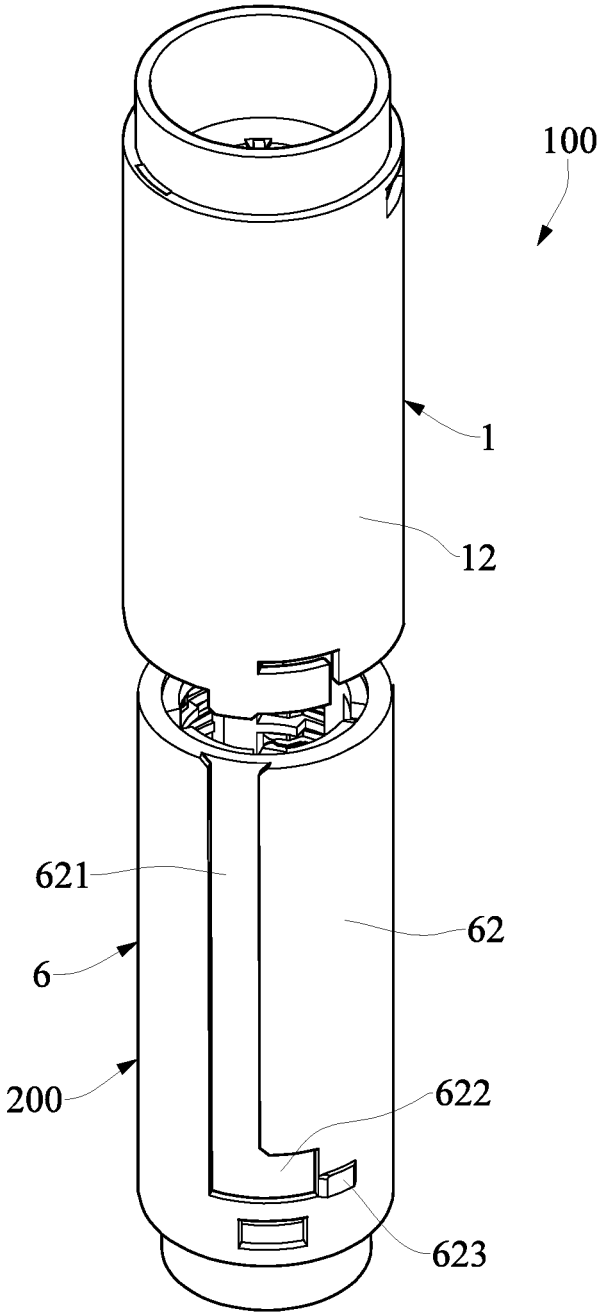
FIG. 4 is a perspective view of the connecting device with high-density contacts of the present disclosure.

The aforementioned illustrations and following detailed descriptions are exemplary for the purpose of further explaining the scope of the present disclosure. Other objectives and advantages related to the present disclosure will be illustrated in the subsequent descriptions and appended drawings.

Reference is made to FIG. 1 to FIG. 4. The present disclosure provides a connecting device with high-density contacts, which includes a plug connector 100 and a socket connector 200.

The plug connector 100 includes a first insulated housing 1 and a plurality of first terminals 2. The first insulated housing 1 can be made of an insulated material, for example, plastic. However, the material and the structure of the first insulated housing 1 are not limited thereto. In this embodiment, the first insulated housing 1 is a male plug member. The first insulated housing 1 has a post portion 11, and the post portion 11 is preferably a cylinder. The first insulated housing 1 further has a first casing 12, and the first casing 12 is preferably a hollow cylinder. The first casing 12 is sleeved around the post portion 11. The post portion 11 and the first casing 12 can be connected integrally, or connected in an assembly manner.

The first terminals 2 are disposed on the post portion 11 of the first insulated housing 1. The first terminals 2 are made of metals with good electrical conductivity or an alloy thereof. The number of the first terminals 2 is not limited, and can be changed according to the practical need. The first terminals 2 respectively have a first contacting portion 21 and a first soldering portion 22. The first contacting portion 21 is shaped in a board or a plate, for example, a square board. One end of the first contacting portion 21 has two sides which are respectively formed with an arched part 211, so that the first terminal 2 can touch the second terminal 7 more smoothly. The first soldering portion 22 in this embodiment is fork-shaped with two prongs, and is connected to one end of the first contacting portion 21. However, the shape of the first soldering portion 22 is not limited thereto. The first contacting portions 21 of the first terminals 2 are exposed outside an outer surface of the post portion 11. In other words, the first contacting portions 21 of the first terminals 2 can pass through the corresponding through holes 111 which are formed on the post portion 11, so as to protrude from the outer surface of the post portion 11. The first contacting portions 21 of the first terminals 2 can be arranged in many rows. In this embodiment, the first contacting portions 21 of the first terminals 2 are arranged in five rows along an axial direction of the post portion 11. However, it is not limited thereto, and the first contacting portions 21 can be arranged in, for example, two, three, four, six, seven, or eight rows.

The plug connector 100 can further include a plurality of circuit boards 3. The circuit boards 3 are disposed in the post portion 11 of the first insulated housing 1. The circuit boards 3 can be, but cannot be limited to, for example, a printed circuit board or a flexible printed circuit (FPC). In this embodiment, the circuit board 3 is a strip-shaped piece, and the first soldering portions 22 of the first terminals 2 are respectively soldered on the circuit boards 3 for electrical connection. The circuit boards 3 further can be electrically connected to another device, such as a cable.

Figure 7:
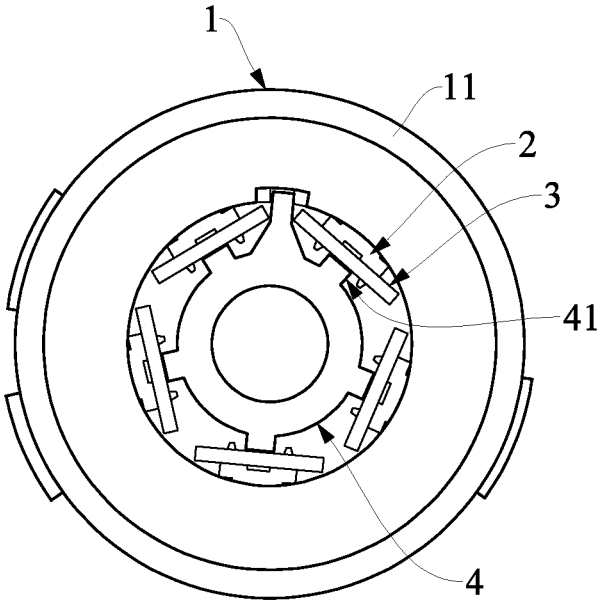
FIG. 7 is a top view of the plug connector of the present disclosure.

The plug connector 100 can further have a column plug 4. The column plug 4 is disposed in the post portion 11 of the first insulated housing 1, and is fixed to the post portion 11 of the first insulated housing 1 in a wedging manner. The column plug 4 has a plurality of propping portions 41. The propping portions 41 are respectively contacted with one side of the circuit boards 3 which is away from the post portion 11 (as shown in FIG. 7). Therefore, the circuit boards 3 and the first terminals 2 can be firmly orientated.

The socket connector 200 includes a second insulated housing 6 and a plurality of second terminals 7. The second insulated housing 6 can be made of an insulated material, for example, plastic. However, the material and the structure of the second insulated housing 6 are not limited thereto. In this embodiment, the second insulated housing 6 is the female type. The second insulated housing 6 has a barrel portion 61. The barrel portion 61 is preferably a hollow cylinder. The second insulated housing 6 further has a second casing 62. The second casing 62 is preferably a hollow cylinder, and is disposed around a periphery of the barrel portion 61. The barrel portion 61 and the second casing 62 can be assembled or integrally formed as one piece. The second casing 62 has an outer diameter that is substantially equal to an inner diameter of the first casing 12, such that the first casing 12 and second casing 62 can be sleeved to each other.

The barrel portion 61 has an inner diameter that is substantially equal to an outer diameter of the post portion 11, such that the post portion 11 can be inserted into the barrel portion 61. In other words, the barrel portion 61 is formed with an accommodating space 63 therein, and the accommodating space 63 can receive the post portion 11 therein. The accommodating space 63 can be in correspondence to the post portion 11 in shape and is annular-shaped. Therefore, when the post portion 11 of the plug connector 100 is inserted into the barrel portion 61 of the socket connector 200, the plug connector 100 and the socket connector 200 are rotatable relative to each other. The barrel portion 61 is formed with a plurality of concave recesses 611 in an inner surface thereof. The concave recesses 611 are arranged correspondingly to the first contacting portion 21 of the first terminals 2. The concave recesses 611 extend along an axial direction of the barrel portion 61. In this embodiment, there are five concave recesses 611, but the number of the concave recesses 611 is not limited thereto; for example, two, three, four, six, seven or eight can be provided.

When the post portion 11 of the plug connector 100 is inserted into the barrel portion 61 of the socket connector 200, the first contacting portions 21 of the first terminals 2 can be received in the concave recesses 611, so as to avoid the barrel portion 61 interfering with the first contacting portions 21 of the first terminals 2. The barrel portion 61 is formed with a plurality of receiving slots 612 that are respectively arranged at one side of the concave recesses 611. The receiving slots 612 of first contacting portion 21 are in spacial communication with the concave recesses 611, such that the first terminals 2 can pass through the concave recesses 611 and enter into the receiving slots 612 to electrically contact with the second terminals 7.

Figure 6:
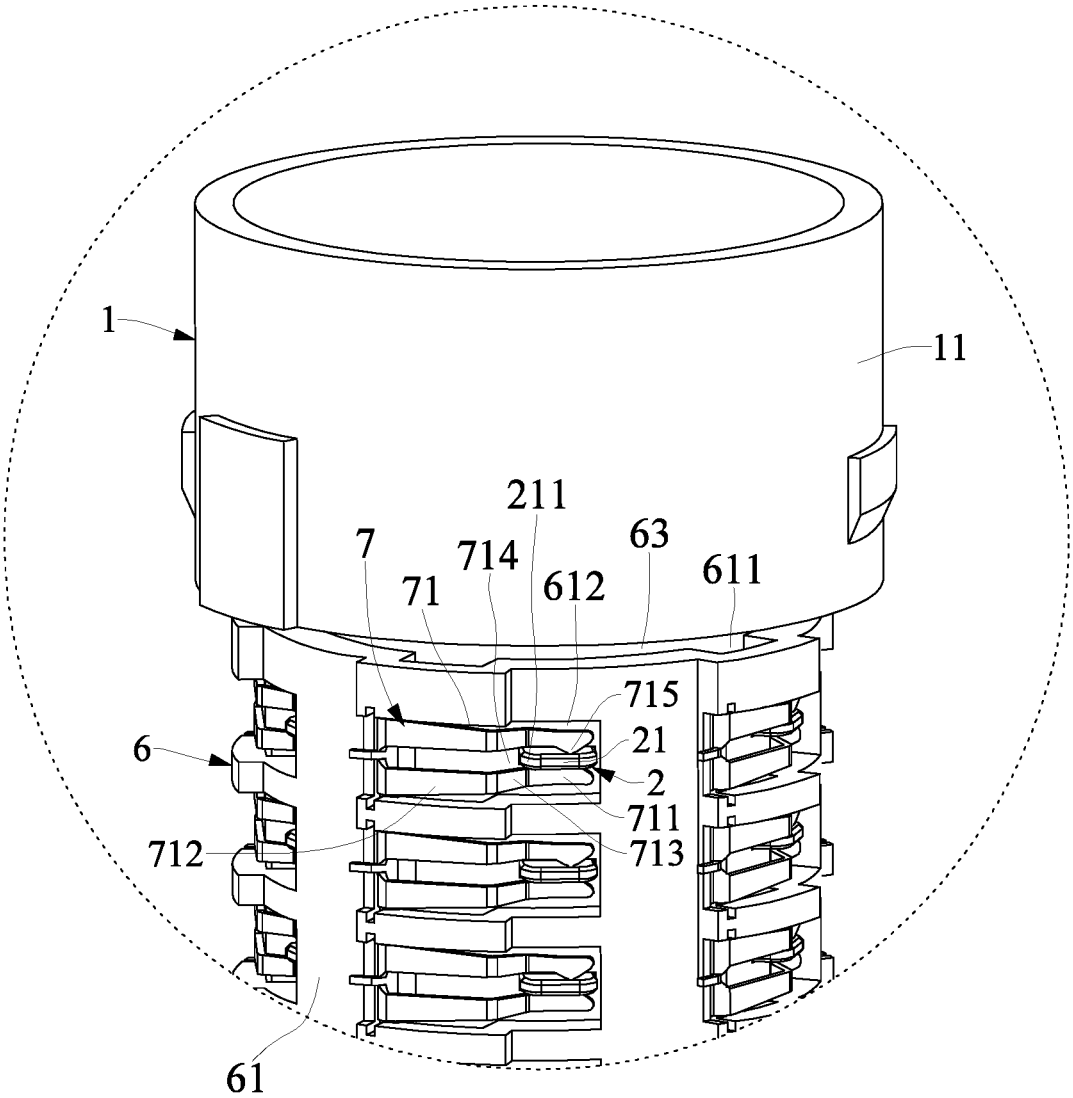
FIG. 6 is a perspective view of a first terminal contacting with a second terminal of the present disclosure.
Figure 8:
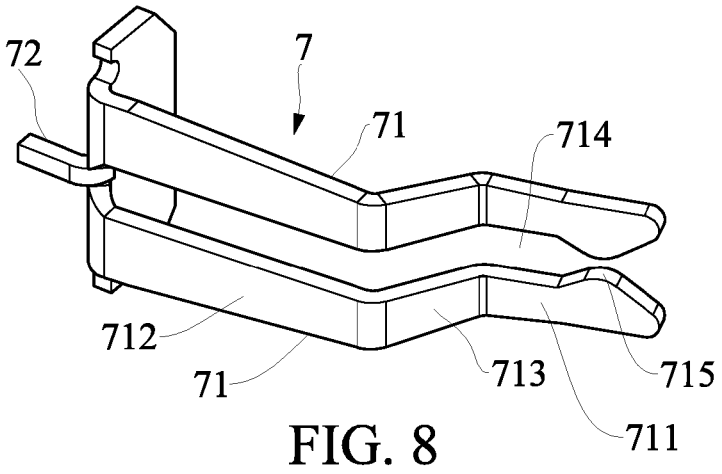
FIG. 8 is a perspective view of the second terminal of the present disclosure.

The second terminals 7 are disposed on the barrel portion 61 of the second insulated housing 6. The second terminals 7 are made of metals with good electrical conductivity or alloy thereof. The number of the second terminals 7 is not limited, and can be changed according to the actual requirement. The second terminals 7 respectively have two second contacting portions 71 and a second soldering portion 72, as shown in FIG. 8. The two second contacting portions 71 can be strip-shaped, and are arranged oppositely to each other. The second soldering portion 72 is connected to the two second contacting portions 71. The second contacting portions 71 of the second terminals 7 are correspondingly disposed in the receiving slot 612, as shown in FIG. 6. The two second contacting portions 71 of the second terminals 7 are arranged in a plurality of rows. In this embodiment, the two second contacting portions 71 of the second terminals 7 are arranged in five rows along an axial direction of the barrel portion 61. However, the number of rows is not limited thereto; for example, two, three, four, six, seven, or eight rows can be employed. In this embodiment, each second contacting portion 71 of the second terminals 7 has a front part 711, a rear part 712 and an intermediate part 713. The intermediate part 713 is connected between the front part 711 and the rear part 712. Between the intermediate part 713 and the front part 711, and between the intermediate part 713 and the rear part 712, an obtuse included angle is formed respectively, such that the second contacting portion 71 is formed to have multi-segment bends. The intermediate part 713 is used to form a drop between the front part 711 and the rear part 712, so that the first contacting portion 21 of the first terminal 2 is conveniently disposed between the two front parts 711 of the two second contacting portions 71 of the second terminal 7. A clipping slot 714 is formed between the two second contacting portions 71 of the second terminal 7, so as to receive the first contacting portion 21 of the first terminal 2. The clipping slot 714 has a longitudinal direction which is perpendicular to a plugging direction of the plug connector 100 and the socket connector 200. Each second contacting portion 71 of the second terminal 7 is formed with a protrusion 715. The protrusion 715 is arranged on the front part 711, and is close to the clipping slot 714. Therefore, two sides of the first contacting portions 21 of the first terminal 2 can touch the two protrusions 715 of the two second contacting portions 71 of the second terminal 7 to achieve a better contacting effect.

Figure 5:
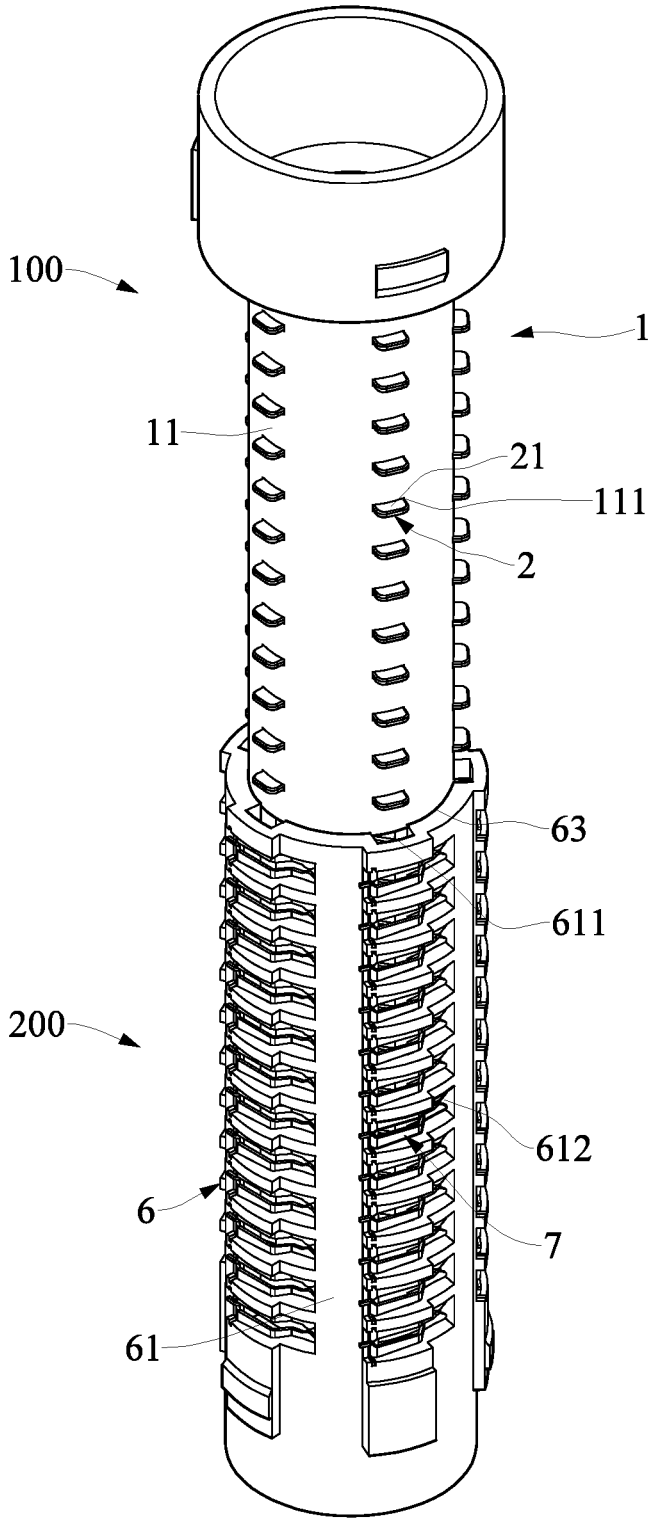
FIG. 5 is a perspective view of the plug connector and the socket connector plugging with each other (first and second casings being hidden) of the present disclosure.

As shown in FIG. 5, the post portion 11 of the plug connector 100 is able to insert into the accommodating space 63 of the socket connector 200, and the plug connector 100 and the socket connector 200 are rotatable relative to each other. As shown in FIG. 6, the first contacting portions 21 of the first terminals 2 are respectively clipped between the two second contacting portions 71 of the second terminals 7. In other words, the first contacting portions 21 of the first terminals 2 are respectively clipped the clipping slot 714 between the two second contacting portions 71 of the second terminals 7. Therefore, the first terminals 2 can be electrically contacted with the second terminals 7, that is, the plug connector 100 and socket connector 200 are electrically connected. The post portion 11 of the plug connector 100 is inserted into the accommodating space 63 of the socket connector 200. The first casing 12 is sleeved around the second casing 62, such that the plug connector 100 and socket connector 200 are assembled more stably.

The front end of the first casing 12 of the plug connector 100, which is close to the socket connector 200, has a guiding block 121 and a locking recess 122. The guiding block 121 is protruded from an inner surface of the first casing 12, and the locking recess 122 is recessed in an inner surface of the first casing 12. The second casing 62 of the socket connector 200 has a guiding groove 621 formed on an outer surface thereof. The guiding groove 621 extends along an axial direction of the socket connector 200. In addition, the rear end of the second casing 62 of the socket connector 200, which is away from the plug connector 100, is formed with a positioning groove 622 and a locking block 623. The positioning groove 622 is recessed in an outer surface of the second casing 62. The positioning groove 622 is in spacial communication with the guiding groove 621. The locking block 623 is protruded from an outer surface of the second casing 62.

Figure 11:
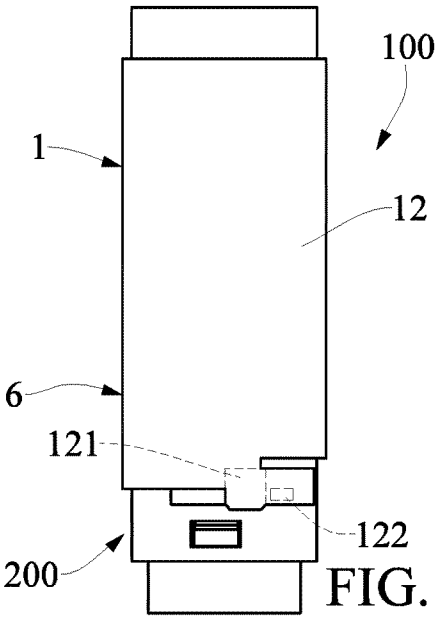
FIG. 11 is a plan view of the plug connector being locked to the socket connector of the present disclosure.
Figure 10:
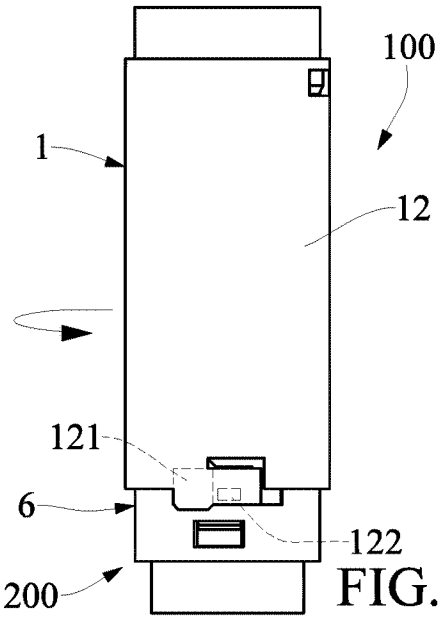
FIG. 10 is a plan view of the plug connector being rotated relative to the socket connector of the present disclosure.
Figure 9:
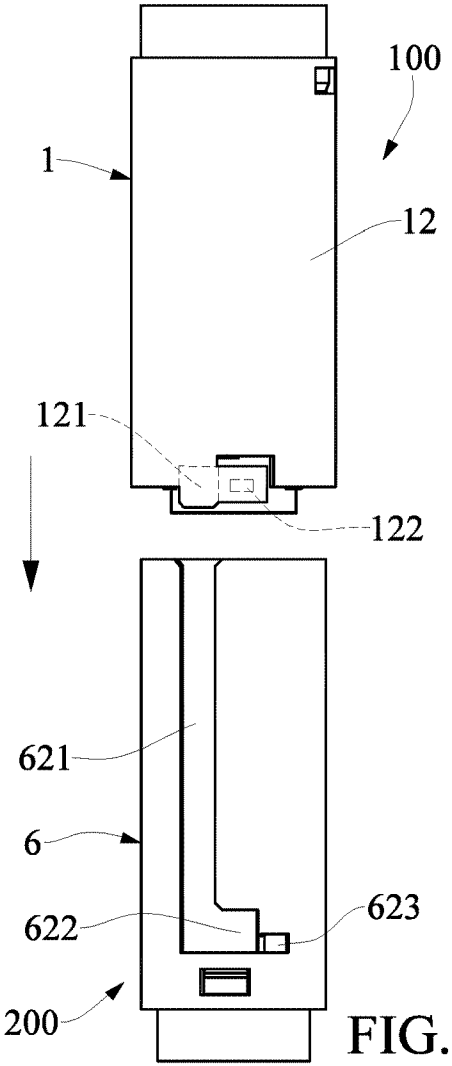
FIG. 9 is a plan view of the plug connector being plugged into the socket connector of the present disclosure.

Reference is made to FIG. 9 to FIG. 11. When the post portion 11 of the plug connector 100 is inserted into the accommodating space 63 of the socket connector 200, the guiding block 121 is able to slide in the guiding groove 621, such that the plug connector 100 and the socket connector 200 are stably inserted into the predetermined positions. When the post portion 11 of the plug connector 100 is inserted into the accommodating space 63 of the socket connector 200 in a predetermined position and the plug connector 100 and the socket connector 200 are rotated relative to each other, the guiding block 121 is able to be moved into the positioning groove 622. In addition, the locking block 623 and the locking recess 122 are mutually engaged fixedly, so as to provide a locking function for the plug connector 100 and the socket connector 200.

To sum up, the present disclosure has the advantages as follows. The plug connector and the socket connector respectively utilize the post portion with the first terminals and the barrel portion with the second terminal, and use the outer surfaces (such as the circumference surface) of the post portion and the barrel portion to the maximum extent to produce high-density and high-reliable signal contacts within a limited volume. In addition, the first contacting portions of the first terminals are clipped between the second contacting portions of the second terminals. Therefore, effective contacting forces can be provided effectively, and the first terminals and the second terminals are stably contacted and conducted. Between the two second contacting portions of the second terminal, the clipping slot is provided, of which the longitudinal direction is perpendicular to the plugging direction of the plug connector and the socket connector, thereby effectively preventing the plug connector and the socket connector from loosening in use.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A connecting device with high-density contacts, comprising:

a plug connector, including a first insulated housing and a plurality of first terminals, the first insulated housing having a post portion, the first terminals disposed on the post portion, wherein the first terminals respectively have a first contacting portion and a first soldering portion, the first soldering portion is connected to the first contacting portion, and the first contacting portions of the first terminals is exposed outside a periphery of the post portion; and a socket connector, including a second insulated housing and a plurality of second terminals, the second insulated housing having a barrel portion, the barrel portion having an accommodating space formed therein, the second terminals being disposed on the barrel portion of the second insulated housing, wherein the second terminals respectively have two second contacting portions and a second soldering portion, and the second soldering portion is connected to the two second contacting portions;

wherein the post portion of the plug connector is capable of inserting into the accommodating space of the socket connector, and the plug connector and the socket connector are rotatable relative to each other, such that the first contacting portions of the first terminals are respectively clipped between the two second contacting portions of the second terminals, and the first terminals are electrically conducted to the second terminals, respectively.

2. The connecting device with high-density contacts as claimed in claim 1, wherein the post portion of the plug connector is a cylinder, and the accommodating space of the socket connector is annular-shaped.

3. The connecting device with high-density contacts as claimed in claim 2, wherein the first insulated housing further has a first casing, the first casing is a hollow cylinder, and the first casing is arranged around the post portion; wherein the second insulated housing further has a second casing, the second casing is a hollow cylinder, and the second casing is arranged around the barrel portion; wherein when the post portion of the plug connector is plugged into the accommodating space of the socket connector, the first casing is sleeved around the second casing.

4. The connecting device with high-density contacts as claimed in claim 3, wherein a front end of the first casing has a guiding block and a locking recess, the guiding block protrudes from an inner surface of the first casing, and the locking recess is formed on an inner surface of the first casing; wherein the second casing has a guiding groove, the guiding groove extends along an axial direction of the socket connector, a rear end of the second casing is formed with a positioning groove and a locking block, the positioning groove is recessed in an outer surface of the second casing, the positioning groove is in spacial communication with the guiding groove, and the locking block protrudes from an outer surface of the second casing; wherein when the post portion of the plug connector is inserted into the accommodating space of the socket connector, the guiding block is rotatable in the guiding groove, the post portion of the plug connector is inserted into the accommodating space of the socket connector to a fixing location; wherein when the plug connector and the socket connector are rotated relative to each other, the guiding block is capable of being moved into the positioning groove, and the locking block is engaged fixedly with the locking recess.

5. The connecting device with high-density contacts as claimed in claim 2, wherein the barrel portion is formed with a plurality of concave recesses on an inner surface thereof, the concave recesses correspond to the first contacting portions of the first terminals, and the concave recesses extend along an axial direction of the barrel portion; wherein when the post portion of the plug connector is inserted into the barrel portion of the socket connector, the first contacting portions of the first terminals are correspondingly received in the concave recesses.

6. The connecting device with high-density contacts as claimed in claim 5, wherein the barrel portion is formed with a plurality of receiving slots, the receiving slots are respectively located on one side of the concave recesses, the receiving slots are in spacial communication with the concave recesses, and the two second contacting portions of the second terminals are respectively disposed in the receiving slots.

7. The connecting device with high-density contacts as claimed in claim 1, wherein the first contacting portion is shaped in a plate, and one end of the first contacting portion has two sides respectively formed with an arched part.

8. The connecting device with high-density contacts as claimed in claim 1, wherein the first contacting portions of the first terminals are arranged in a plurality of rows along an axial direction of the post portion, and the two second contacting portions of the second terminals are arranged in a plurality of rows along an axial direction of the barrel portion.

9. The connecting device with high-density contacts as claimed in claim 1, wherein the two second contacting portions of the second terminals are strip-shaped and are arranged oppositely to each other; wherein the two second contacting portions of the second terminals respectively have a front part, a rear part and an intermediate part, the intermediate part is connected between the front part and the rear part, an included angle is formed between the intermediate part and the front part, and an included angle is formed between the intermediate part and the rear part, such that the second contacting portion is formed to have multi-segment bends.

10. The connecting device with high-density contacts as claimed in claim 1, wherein the plug connector further includes a plurality of circuit boards, the circuit boards are disposed in the post portion of the first insulated housing, and the first soldering portions of the first terminals are respectively soldered to the circuit boards for electrical connection.

11. The connecting device with high-density contacts as claimed in claim 10, wherein the plug connector further includes a column plug, the column plug is disposed in the post portion of the first insulated housing, and the column plug is fixed to the post portion of the first insulated housing; wherein the column plug has a plurality of propping portions, and the propping portions are respectively contacted with one side of the circuit boards which is away from the post portion.

12. The connecting device as claimed in claim 1, wherein each two of the second contacting portions of the second terminals are formed with a clipping slot, and a longitudinal direction of the clipping slot is perpendicular to a plugging direction of the plug connector and the socket connector; wherein the first contacting portions of the first terminals are respectively clipped in the clipping slot between the two second contacting portions of the second terminals.

13. The connecting device with high-density contacts as claimed in claim 12, wherein each of the two second contacting portions of the second terminals is formed with a protrusion, and the protrusion is close to the clipping slot, such that two sides of the first contacting portion of the first terminals respectively touch the protrusions of the two second contacting portions of the second terminals.

* * * * *